US007931143B1

(12) United States Patent
Lin

(10) Patent No.: US 7,931,143 B1
(45) Date of Patent: Apr. 26, 2011

(54) TOOLBOX

(75) Inventor: Jack Lin, Taichung (TW)

(73) Assignee: Yih Cheng Factory Co., Ltd, Taichung (TW)

( * ) Notice: Subject to any disclaimer, the term of this patent is extended or adjusted under 35 U.S.C. 154(b) by 0 days.

(21) Appl. No.: 12/707,936

(22) Filed: Feb. 18, 2010

(51) Int. Cl.
*B65D 85/28* (2006.01)
*B65D 25/24* (2006.01)

(52) U.S. Cl. ..... 206/373; 206/379; 220/629

(58) Field of Classification Search ..... 206/379, 206/372, 349; 312/290, 291, 293.1; 211/70.6, 211/71.01, 88.01; 220/3.7, 4.31–4.34, 629, 220/379
See application file for complete search history.

(56) References Cited

U.S. PATENT DOCUMENTS

| | | | | |
|---|---|---|---|---|
| 5,762,411 | A * | 6/1998 | Yemini | 312/290 |
| 7,322,470 | B2 * | 1/2008 | Brunson | 206/372 |
| 7,334,680 | B2 * | 2/2008 | Cunningham et al. | 206/372 |
| 7,600,640 | B2 * | 10/2009 | Hallee et al. | 206/373 |
| 2005/0241974 | A1 * | 11/2005 | Chen | 206/379 |
| 2006/0196793 | A1 * | 9/2006 | Pendergraph et al. | 206/372 |
| 2007/0114150 | A1 * | 5/2007 | Lin | 206/372 |
| 2009/0266730 | A1 * | 10/2009 | Lin | 206/372 |

* cited by examiner

*Primary Examiner* — Mickey Yu
*Assistant Examiner* — Rafael Ortiz

(57) ABSTRACT

A toolbox includes two pivotally connected shells, a buckling unit and at least one tool-holding unit. Each of the shells includes at least two primary partitions formed on an internal side thereof, a compartment defined between the primary partitions, a row of ribs formed one each of the primary partitions, and gaps each defined between two adjacent ones of the ribs. The bucking unit can buckle the shells to each other. The tool-holding unit is engaged with the rows of ribs of selected one of the shells.

12 Claims, 14 Drawing Sheets

TOOLBOX

BACKGROUND OF INVENTION

1. Field of Invention

The present invention relates to tools and, more particularly, to a toolbox for containing various tools.

2. Related Prior Art

Tools such as drivers, bits, wrenches and sockets are often contained in a toolbox so that these tools can be carried conveniently. There have been various toolboxes. As disclosed in Taiwanese Patent Publication No. 262786, a toolbox includes two shells. An edge of one of the shells is connected to an edge of the other shell with hinges. An opposite edge of one of the shells is detachably connected to an opposite edge of the other shell with a buckle. Various compartments are defined in an internal face of each of the shells.

Therefore, the present invention is intended to obviate or at least alleviate the problems encountered in prior art.

SUMMARY OF INVENTION

It is the primary objective of the present invention to provide a convenient, reliable toolbox.

To achieve the foregoing objective, the toolbox includes A toolbox includes two pivotally connected shells, a buckling unit and at least one tool-holding unit. Each of the shells includes at least two primary partitions formed on an internal side thereof, a compartment defined between the primary partitions, a row of ribs formed one each of the primary partitions, and gaps each defined between two adjacent ones of the ribs. The bucking unit can buckle the shells to each other. The tool-holding unit is engaged with the rows of ribs of selected one of the shells.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
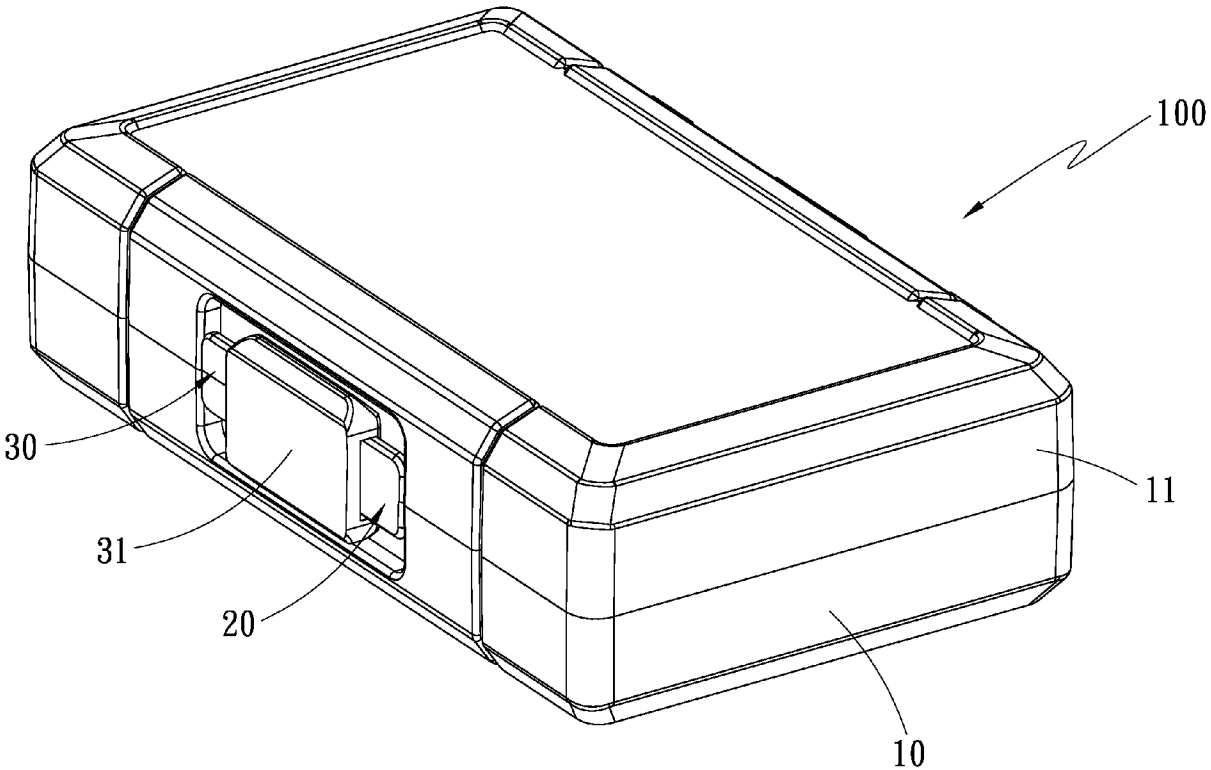
FIG. 1 is a perspective view of a toolbox according to the first embodiment of the present invention.

Referring to FIGS. 1, 2, 5 and 7, a toolbox 100 includes a first shell 10, a second shell 11, a buckling unit and a tool-holding unit 40 according to a first embodiment of the present invention. The buckling unit includes a first buckle-engaging element 20, a second buckle-engaging element 30 and a buckle 31. The tool-holding unit 40 includes a slide 50, a holder 60 and anchors 70.

Each of the shells 10 and 11 includes various compartments 12 separated from one another with primary partitions 13 extending on an internal side thereof. A row of ribs 14 extends on each of two opposite primary partitions 13 of the largest compartment 12. Each row of ribs 14 are used as a track. Each of the ribs 14 includes a chamfered portion. A gap 15 is defined between any two adjacent ones of the ribs 14. Slots 16 are defined in each of the opposite primary partitions 13 of the largest compartment 12. Triangular marks 17 are formed the edge of each of the opposite primary partitions 13 of the largest compartment 12.

Figure 2:
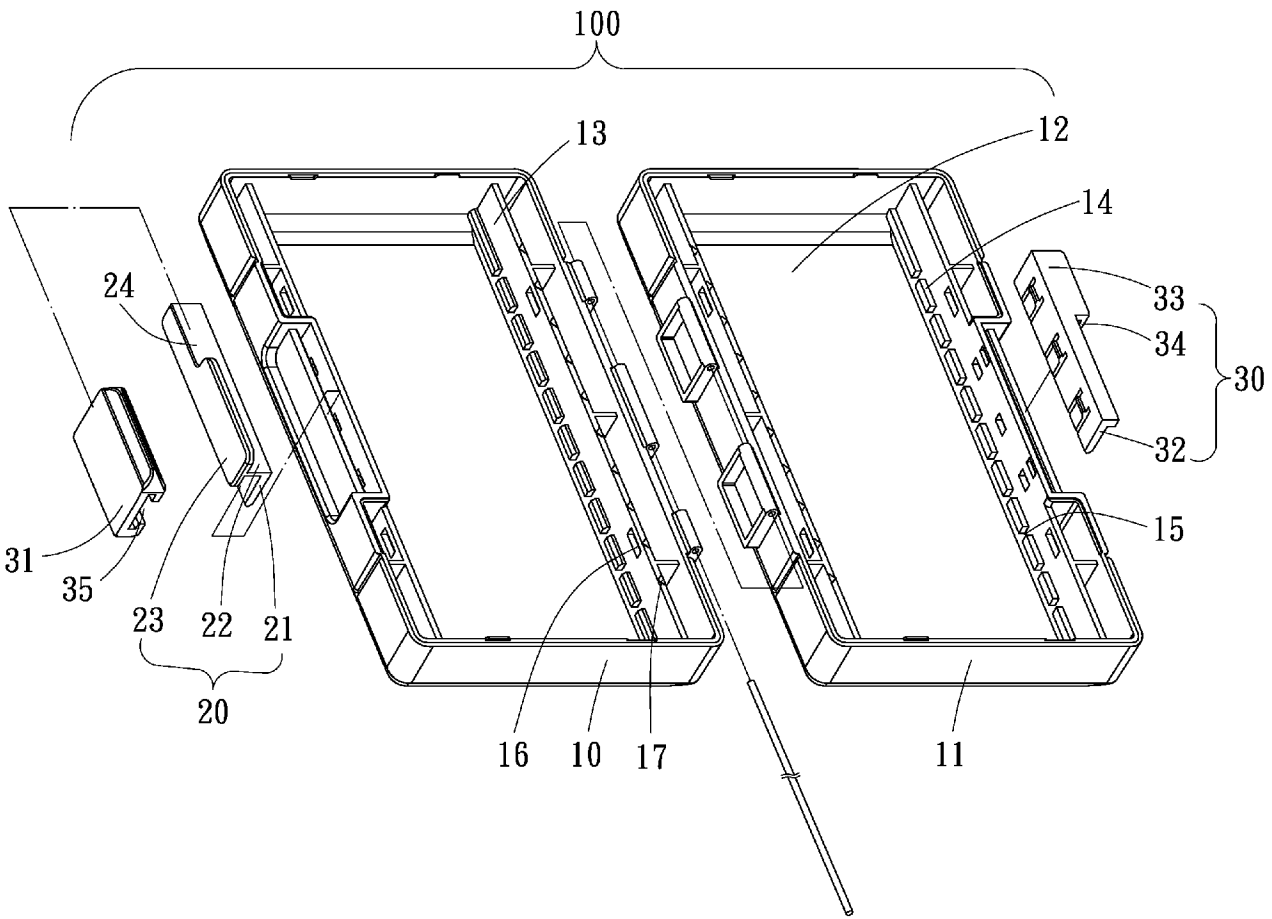
FIG. 2 is a partial, exploded view of the toolbox shown in FIG. 1.
Figure 4:
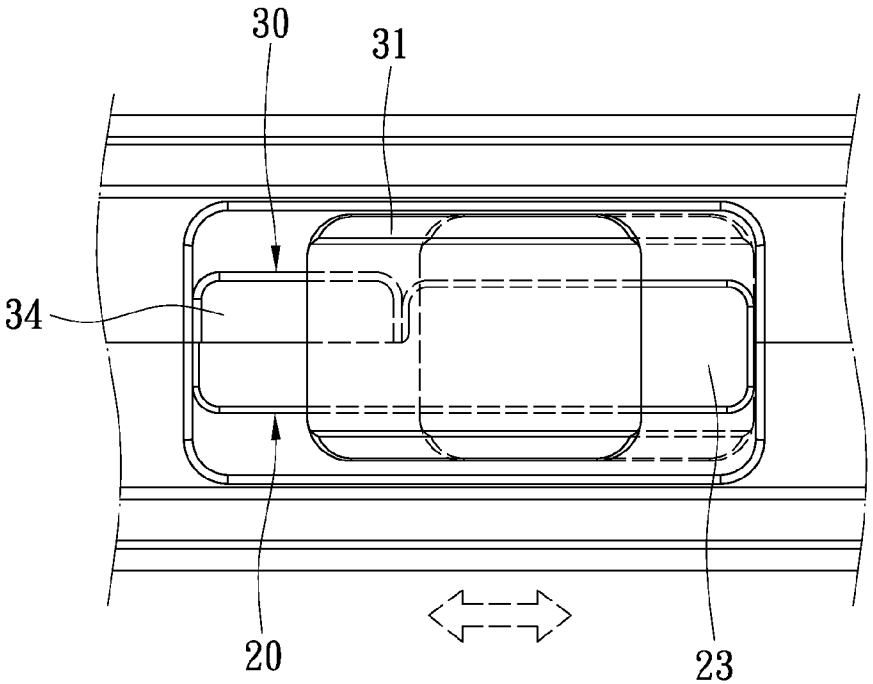
FIG. 4 is a partial, front view of the toolbox shown in FIG. 1.
Figure 3:
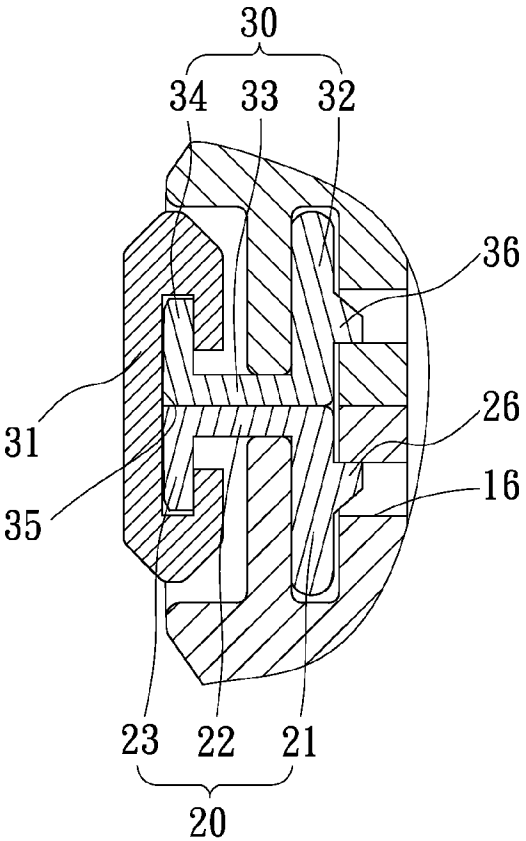
FIG. 3 is a partial, cross-sectional view of the toolbox shown in FIG. 1.

Referring to FIGS. 2 through 4, the first buckle-engaging element 20 includes a vertical plate 21, a horizontal plate 22 extending from the vertical plate 21, and a vertical flange 23 extending from the horizontal plate 22, barbs 26 extending from the vertical plate 21. A cutout 24 is defined in the vertical flange 23. The vertical plate 21 is inserted in one of the compartments 12 of the first shell 10 and the barbs 26 are inserted in the slots 16 of the first shell 10 so that the first buckle-engaging element 20 is attached to the first shell 10.

The second buckle-engaging element 30 includes a vertical plate 32, a horizontal plate 33 extending from the vertical plate 32, and a vertical flange 34 extending from the horizontal plate 33, barbs 36 extending from the vertical plate 32. The vertical plate 32 is inserted in one of the compartments 12 of the second shell 11 and the barbs 36 are inserted in the slots 16 of the second shell 11 so that the second buckle-engaging element 30 is attached to the second shell 11.

The buckle 31 includes a dovetail or T-shaped groove 35. The length of the buckle 31 is smaller than that of the flange 23.

The flange 23 of the first buckle-engaging element 20 is inserted in the dovetail groove 35 before the vertical plate 21 of the first buckle-engaging element 20 is inserted in the related compartment 12 of the first shell 10.

When the shells 10 and 11 are closed, the horizontal plates 22 and 33 are located against each other. The cutout 24 receives the flange 34, i.e., the flanges 23 and 34 are located in a same plane. The buckle 31 can be moved to a locking position (FIGS. 3 and 4) from a releasing position. In the locking position, the buckle 31 is engaged with the flanges 23 and 34 respectively of the buckle-engaging elements 20 and 30. Thus, the toolbox 100 is retained in the closed position.

Figure 5:
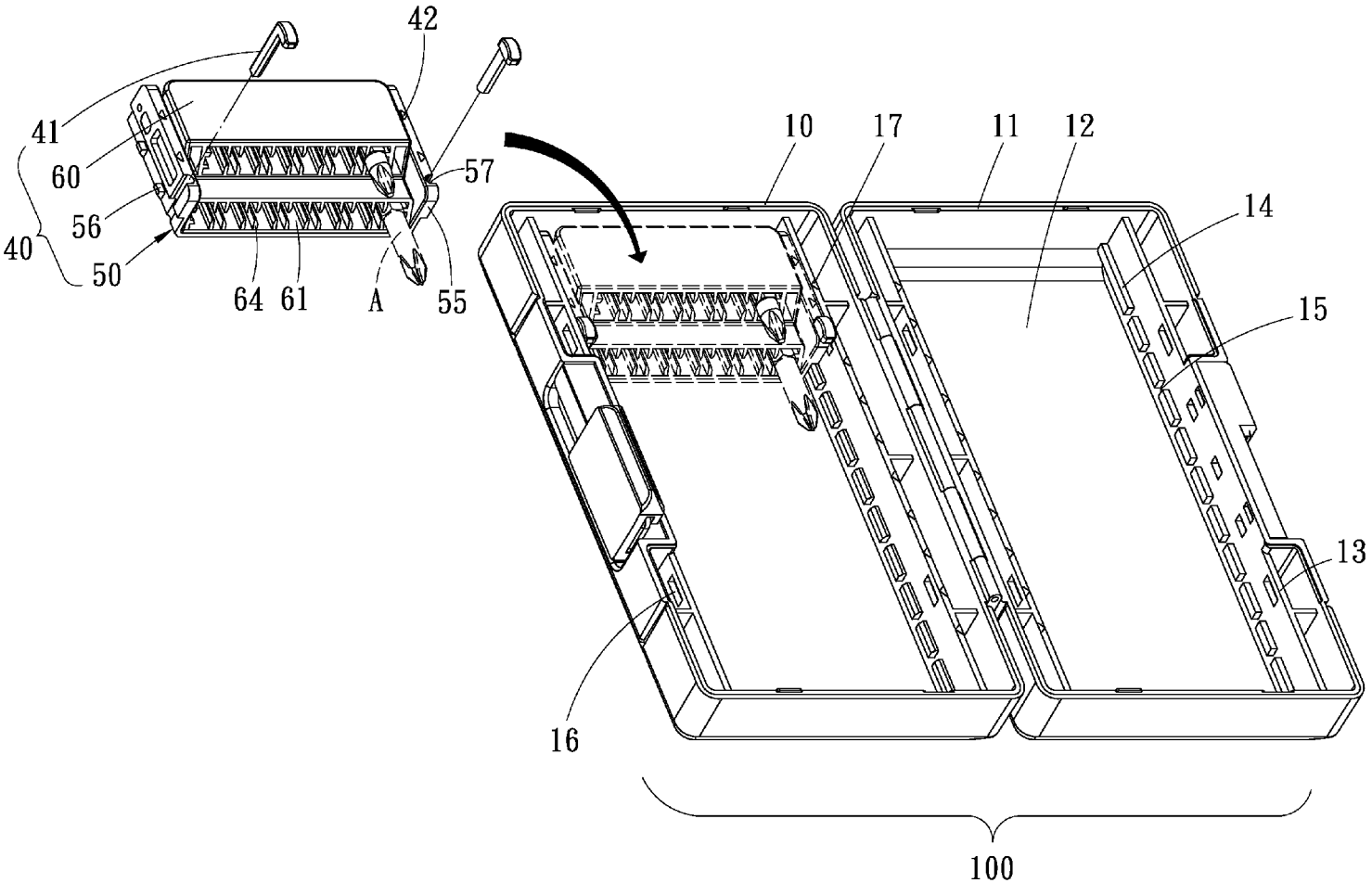
FIG. 5 is an exploded view of the toolbox shown in FIG. 1.
Figure 6:
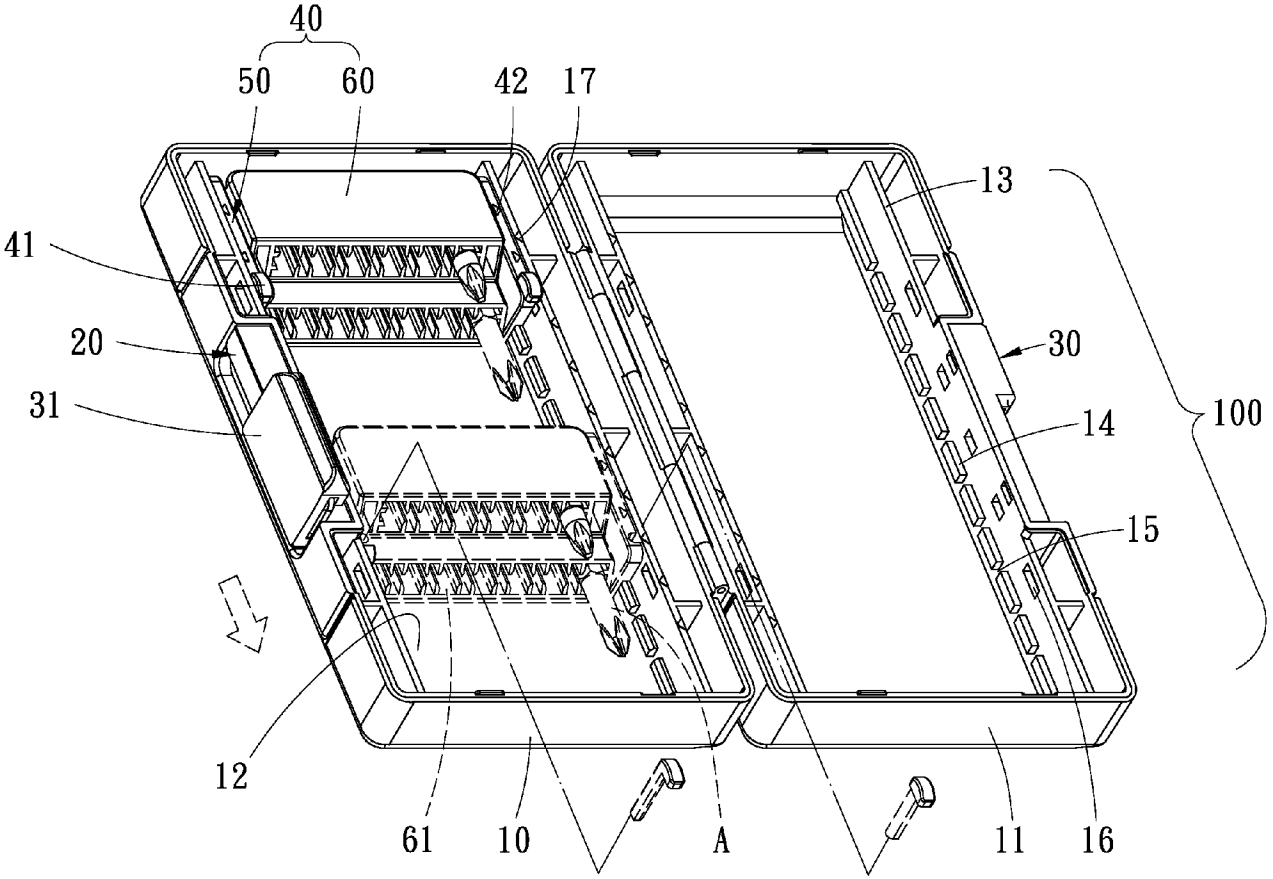
FIG. 6 is a perspective view of the toolbox in another position than shown in FIG. 5.

Referring to FIGS. 5 and 6, the slide 50 is movably supported on the tracks consisting of the rows of ribs 14. The holder 60 is pivotally connected to the slide 50. Various tools A can be held by the holder 60.

Figure 7:
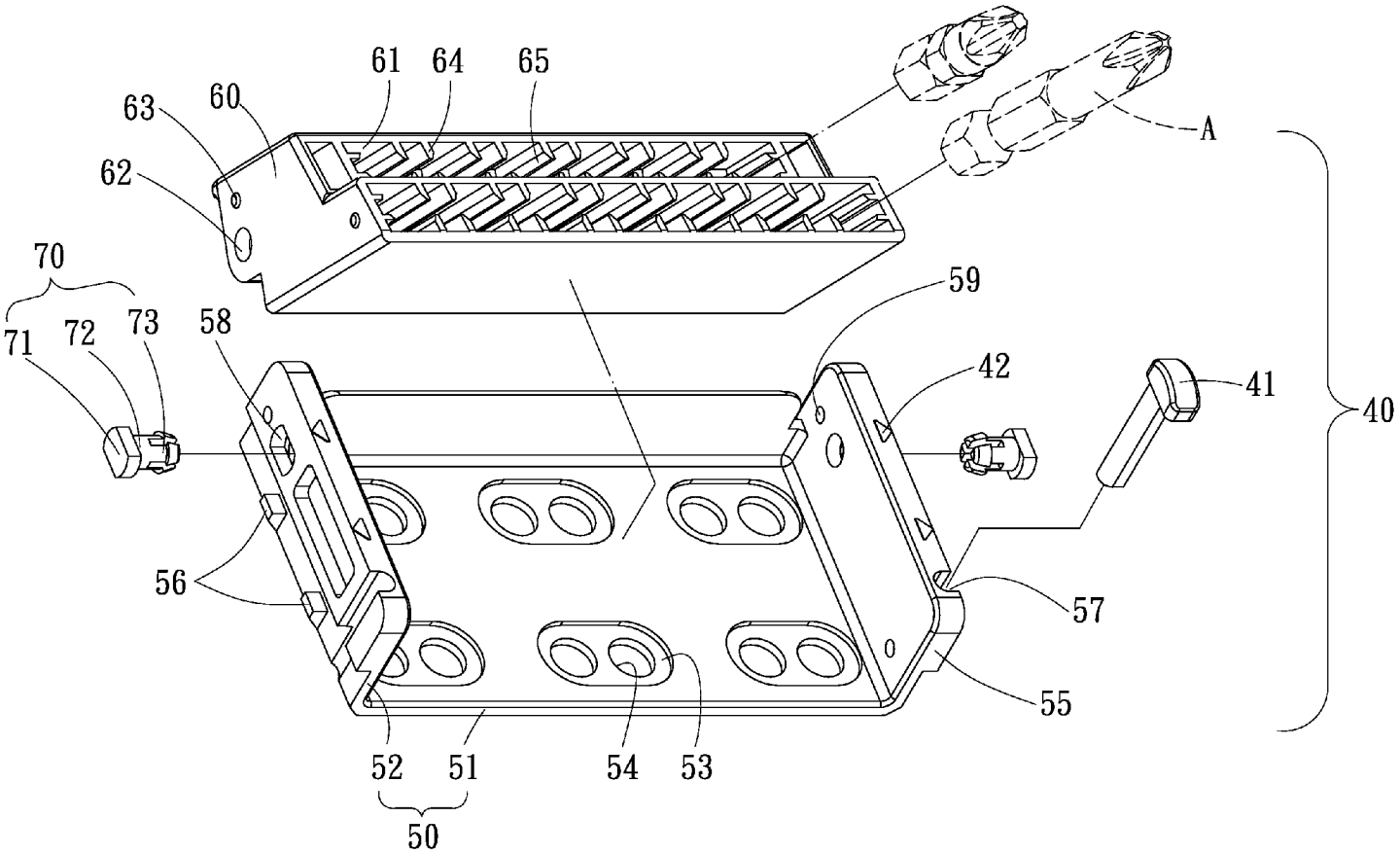
FIG. 7 is another partial, exploded view of the toolbox shown in FIG. 1.

Referring to FIG. 7, the slide includes a floor 51 and two walls extending on the wall 51. Cavities 53 are defined in an upper face of the floor 51. Within each of the cavities 53, two apertures 54 are defined in the floor 51. Each of the walls 51 includes two triangular marks 42 formed on the edge, a wing 55 extending on an external side thereof, two blocks 56 extending on the external side thereof below the wing 55, a channel 57 defined in the external side thereof, apertures 58 defined therein, and two recesses 59 defined in an external side thereof. Each of the blocks 56 includes a chamfered portion corresponding to that of each of the ribs 14. Regarding each of the walls 51, the channel 57 includes an open end in the edge thereof. Each of the apertures 58 includes an enlarged section, thus forming a shoulder between the sections thereof.

Figure 8:
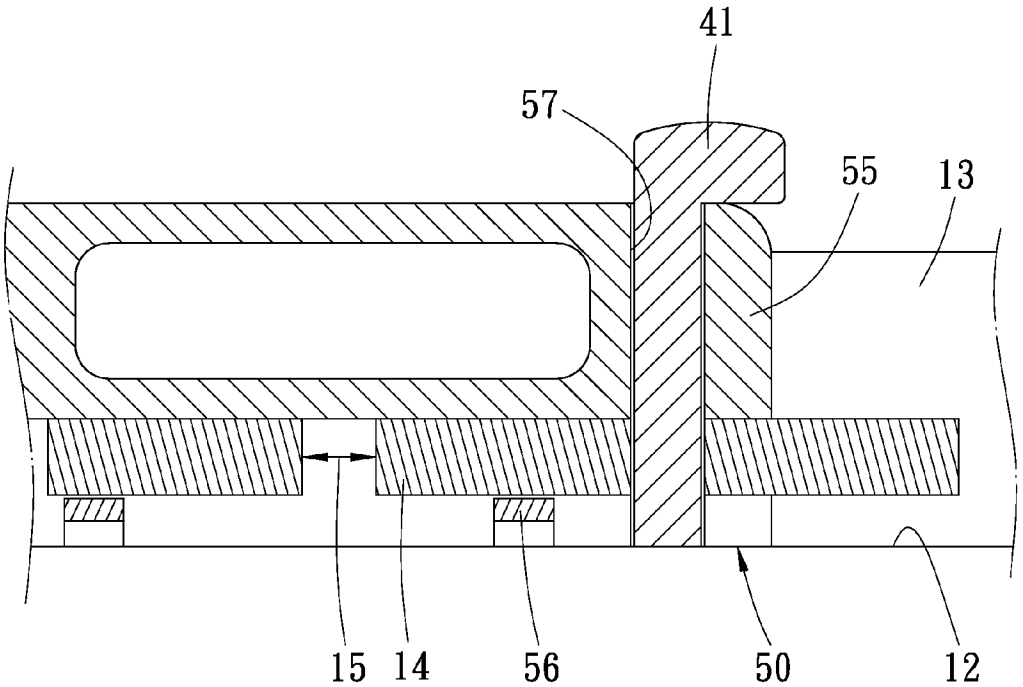
FIG. 8 is another partial, cross-sectional view of the toolbox of FIG. 1.

The following description will be focused on only one of the walls 22 and a related one of the primary partitions 13 of the largest compartment 12. The width of the blocks 56 is smaller than the width of the gaps 15 so that the blocks 56 can be moved through the gaps 15. The chamfered portions of the blocks 56 and the chamfered portions of the ribs 14 facilitate the movement of the blocks 56 through the gaps 15. When any one of the marks 42 is aligned with any one of the marks 17, the blocks 56 are aligned with some of the gaps 15, and the blocks 56 can be moved through the gaps 15. The thickness of the ribs 14 is smaller than the gap 15 between the wing 55 and the blocks 56 so that the ribs 14 are moved in the gap 15 while the wing 55 is moved on the track formed by the row of ribs 14. As clearly shown in FIG. 8, a pin 41 is inserted in a selected one of the gaps 15 through the channel 57 to keep the slide 50 in a selected position on one of the shells 10 and 11. Obviously, the slide 50 is movable on one of the shells 10 and 11 again when the pin 41 is located out of the gaps 15.

The holder 60 includes pockets 61 defined therein between two walls thereof, ribs 64 between any two adjacent ones of the pockets 61, an aperture 62 defined in each of the walls thereof, and two bosses 63 formed on each of the walls thereof. Each of the ribs 64 includes a chamfered portion 65.

Each of the anchors 70 includes an enlarged and 71 and a slit enlarged end 73 and a shaft 72 extending between the ends 71 and 73. The enlarged end 71 is shaped corresponding to the enlarged section of the aperture 58 of each of the walls 52.

Figure 9:
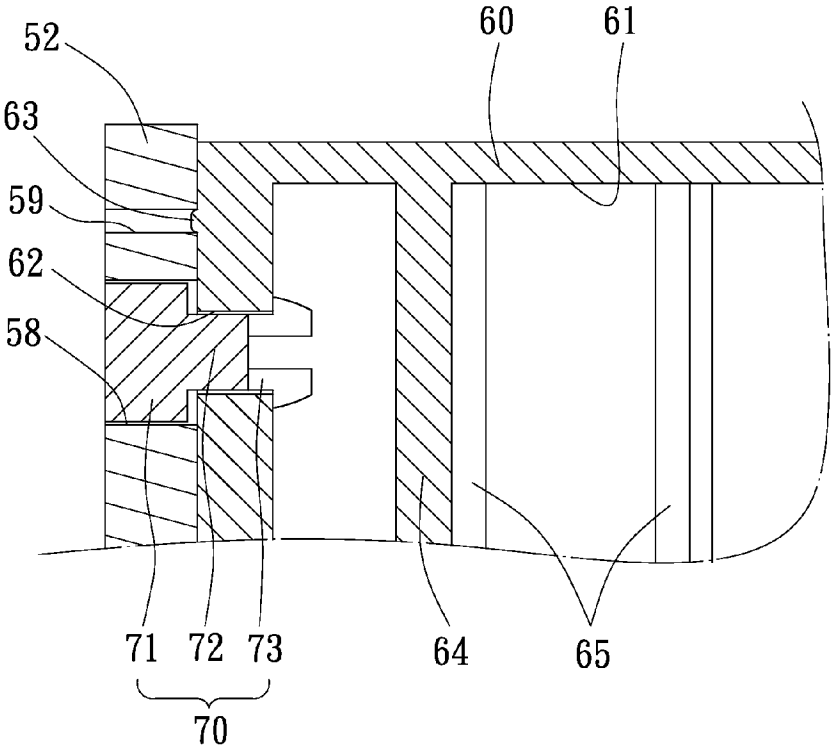
FIG. 9 is another partial, cross-sectional view of the toolbox of FIG. 1.

Referring to FIG. 9, the slit enlarged end 73 of each of the anchors 70 is forced through the aperture 58 of a related one of the walls 52 and a related one of the apertures 62. The slit enlarged end 73 of each of the anchors 70 is located against a related one of the walls of the holder 60 while the enlarged head 71 is located against the shoulder formed in the aperture 58 of a related one of the walls 52. Thus, the holder 60 is pivotally connected to the slide 50.

Figure 10:
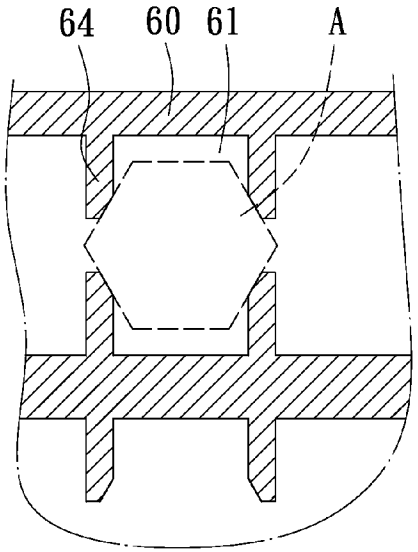
FIG. 10 is another partial, cross-sectional view of the toolbox of FIG. 1.

Referring to FIG. 10, the chamfered portion 65 of each of the ribs 64 is in firm contact with one of six faces of a related one of the tools A. Thus, the tools A are held by the holder 60.

Figure 11:
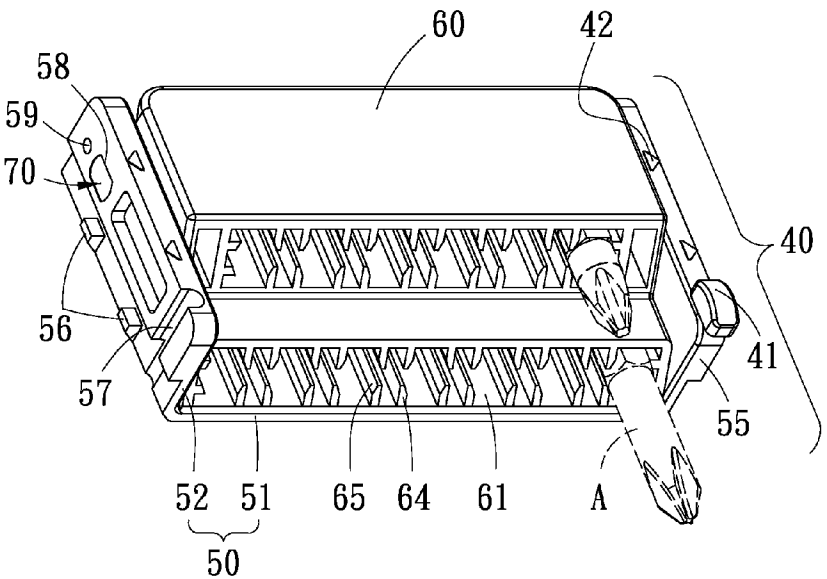
FIG. 11 is a partial, perspective view of the toolbox shown in FIG. 1.

Referring to FIG. 11, the holder 60 is laid down on the slide 50. One of the bosses 63 of each of the walls of the holder 60 is located in a related one of the recesses 59 of a related one of the walls 52 of the slide 50. Thus, the holder 60 is retained in the laid-down position on the slide 50.

Figure 12:
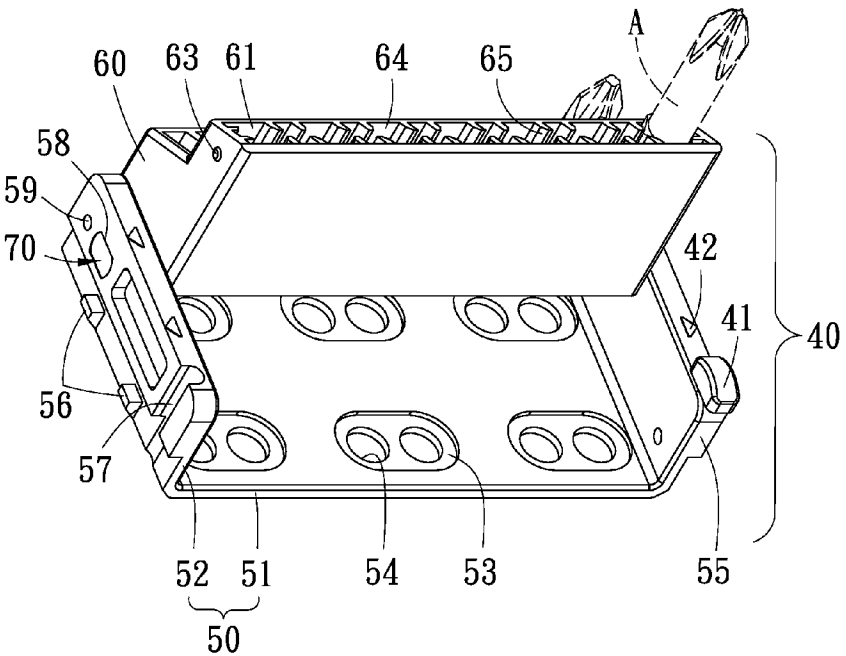
FIG. 12 is another partial, perspective view of the toolbox in another position than shown in FIG. 11.

Referring to FIG. 12, the holder 60 is located in an upright position on the slide 50. The other boss 63 of each of the walls of the holder 60 is located in the other recess 59 of a related one of the walls 52 of the slide 50. Thus, the holder 60 is retained in the upright position on the slide 50.

Figure 13:
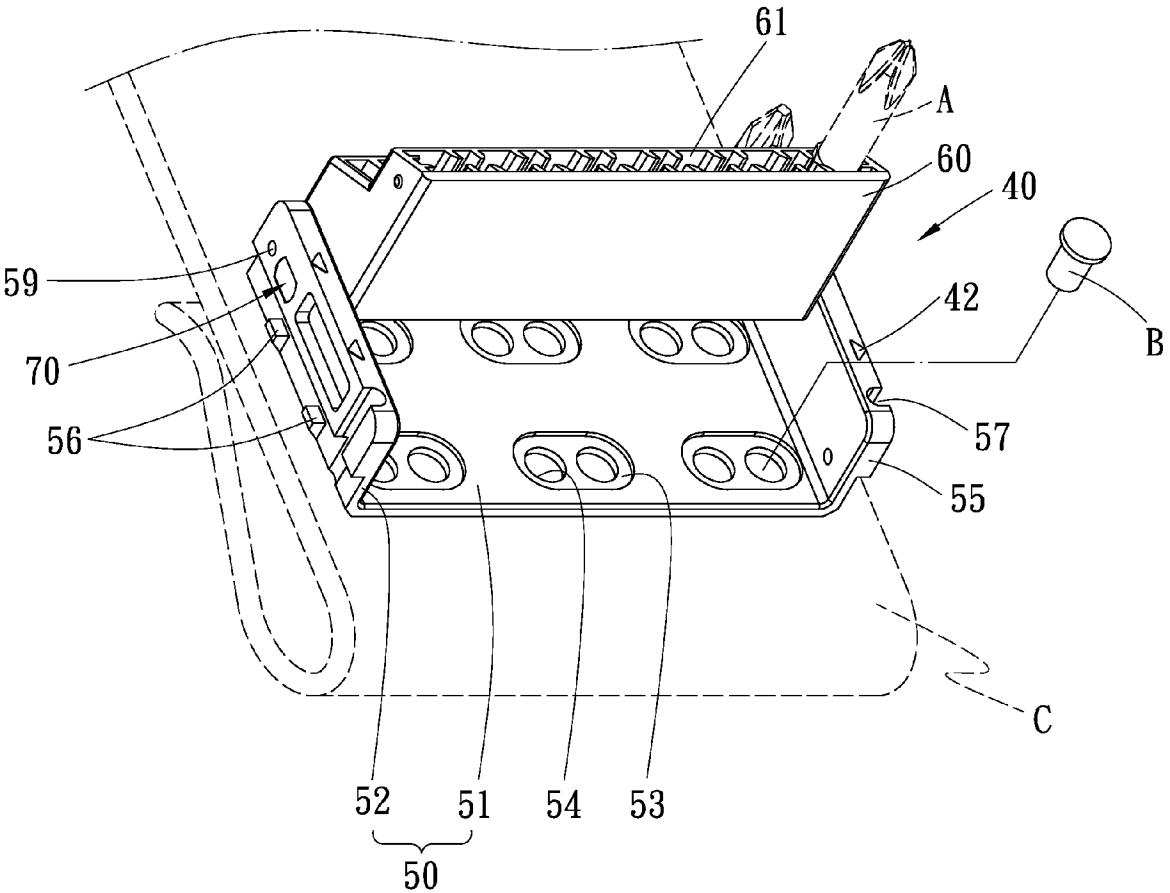
FIG. 13 is a partial, perspective view of the toolbox in another position than shown in FIG. 12.
Figure 14:
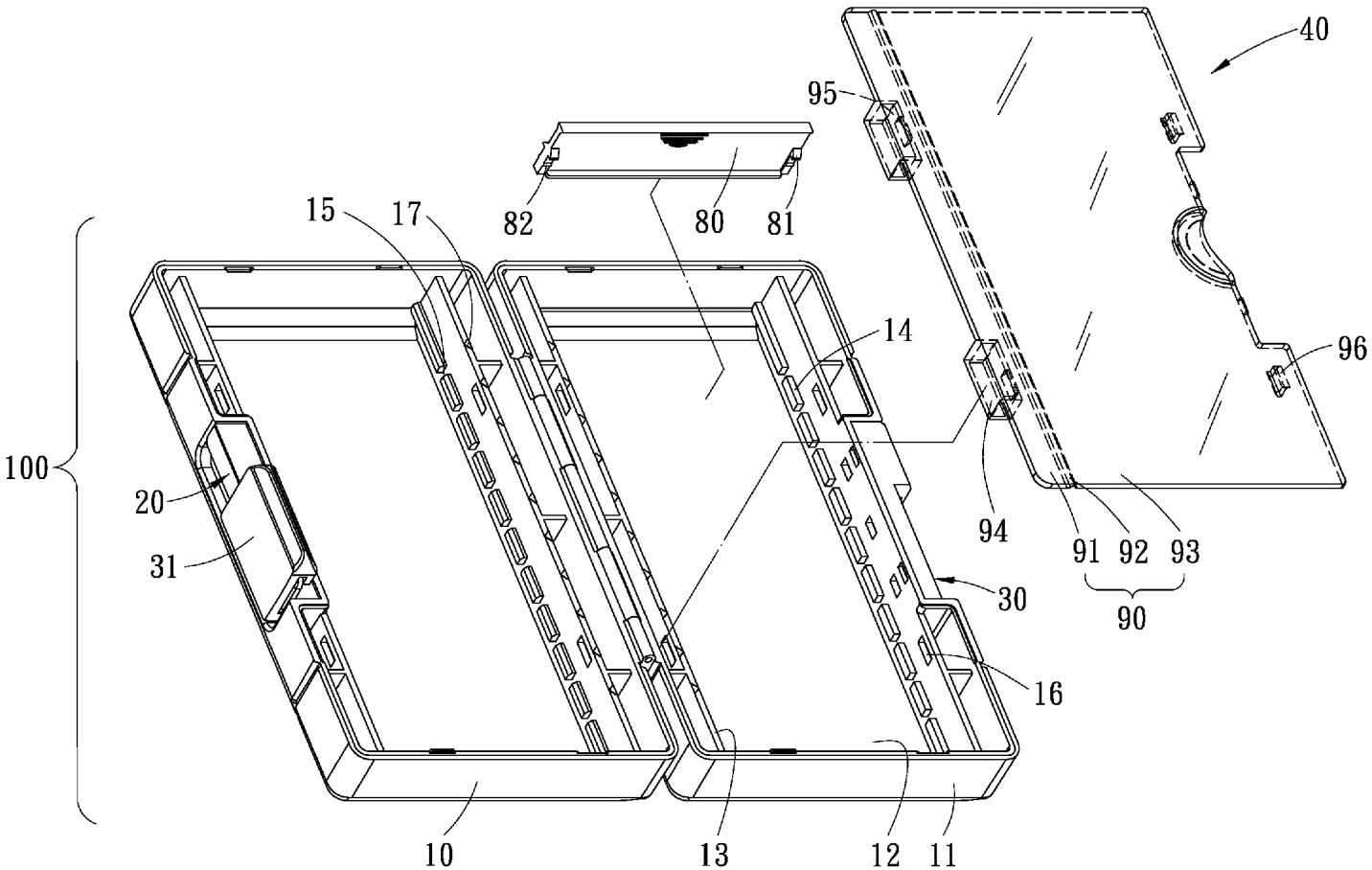
FIG. 14 is a partial, exploded view of a toolbox according to the second embodiment of the present invention.

Referring to FIG. 13, a fastener B can be inserted through a selected one of the apertures 54 and driven in a fixture C. Thus, the tool-holding unit 40 can be attached to the fixture C.

Referring to FIGS. 14 through 17, there is shown a toolbox 100 according to a second embodiment of the present invention. The second embodiment is like the first embodiment except that the tool-holding unit 40 includes at least one secondary partition 80 and an internal cover 90 instead of the slide 50, the holder 60 and the anchors 70.

Figure 15:
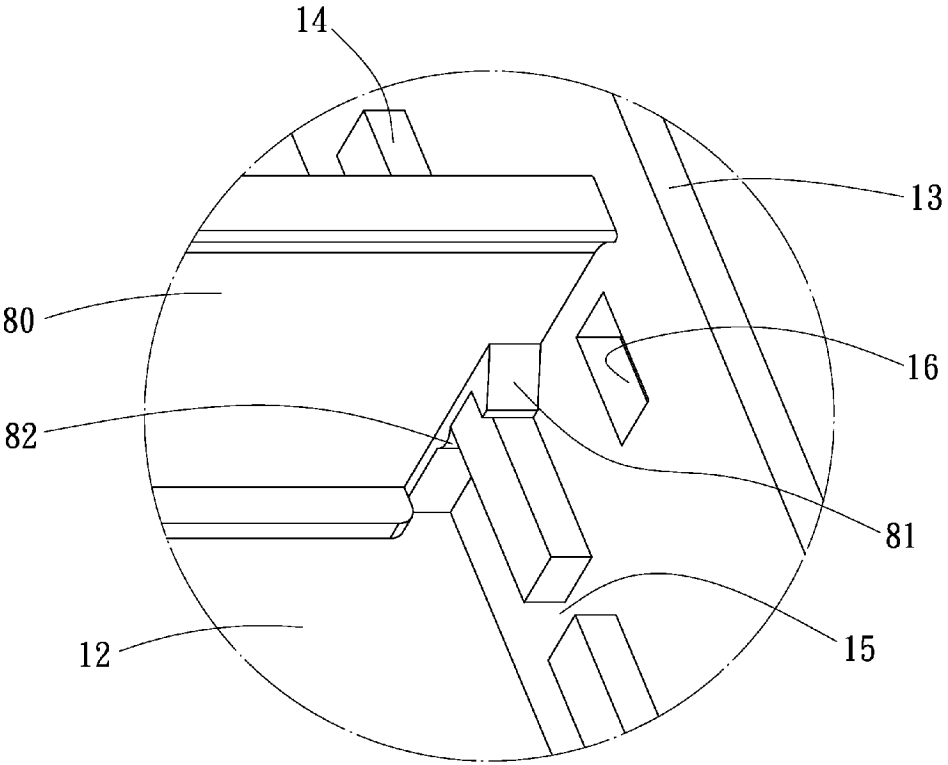
FIG. 15 is a partial, perspective view of the toolbox shown in FIG. 14.

Referring to FIG. 15, the secondary partition 80 includes two opposite faces, two barbs 81 formed on each of the opposite faces, and two bosses 82 formed on each of the opposite faces. The thickness of the secondary partition 80 is smaller than the width of the gaps 15 so that the secondary partition 80 can be inserted through a related one of the gaps 15. The bosses 82 are forced through the ribs 14 between which the related gap 15. The ribs 14 are located between the bosses 82 and the barbs 81. Thus, the secondary partition 80 is attached to the second shell 11.

The internal cover 90 is made of a transparent material. The internal cover 90 includes a stationary portion 91, a pivotal portion 93 and a flexible portion 92 for pivotally connecting the pivotal portion 93 to the stationary portion 91. Two anchors 94 are formed on the stationary portion 91. Each of the anchors 94 includes a barb 95 formed thereon. Two elastic hooks 96 are formed on the pivotal portion 93. Each of the elastic hooks 96 includes a barb formed thereon.

The anchors 94 are located in a related one of the compartments 12 and the barbs 95 are fit in two related one of the slots 16. Thus, the stationary portion 91 of the internal cover 90 is attached to the second shell 11.

Figure 16:
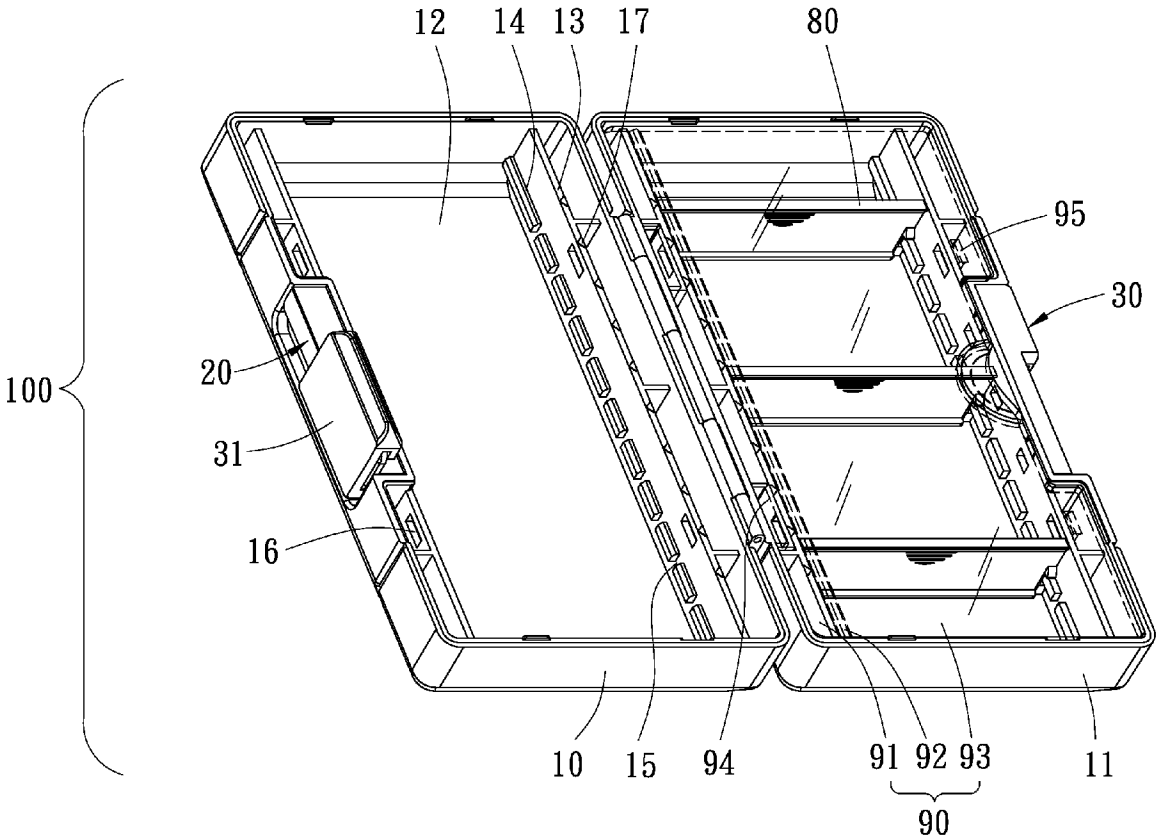
FIG. 16 is a perspective view of the toolbox shown in FIG. 14.

Referring to FIG. 16, the compartments 12 of the second shell 11 are closed with the internal cover 90. The elastic hooks 96 are inserted in a related one of the compartments 12, and the barbs thereof are fit in two related one of the slots 16. The pivotal portion 93 of the internal cover 90 is attached to the second shell 11 detachably. Thus, the compartments 12 of the second shell 11 are retained in the closed position.

Figure 17:
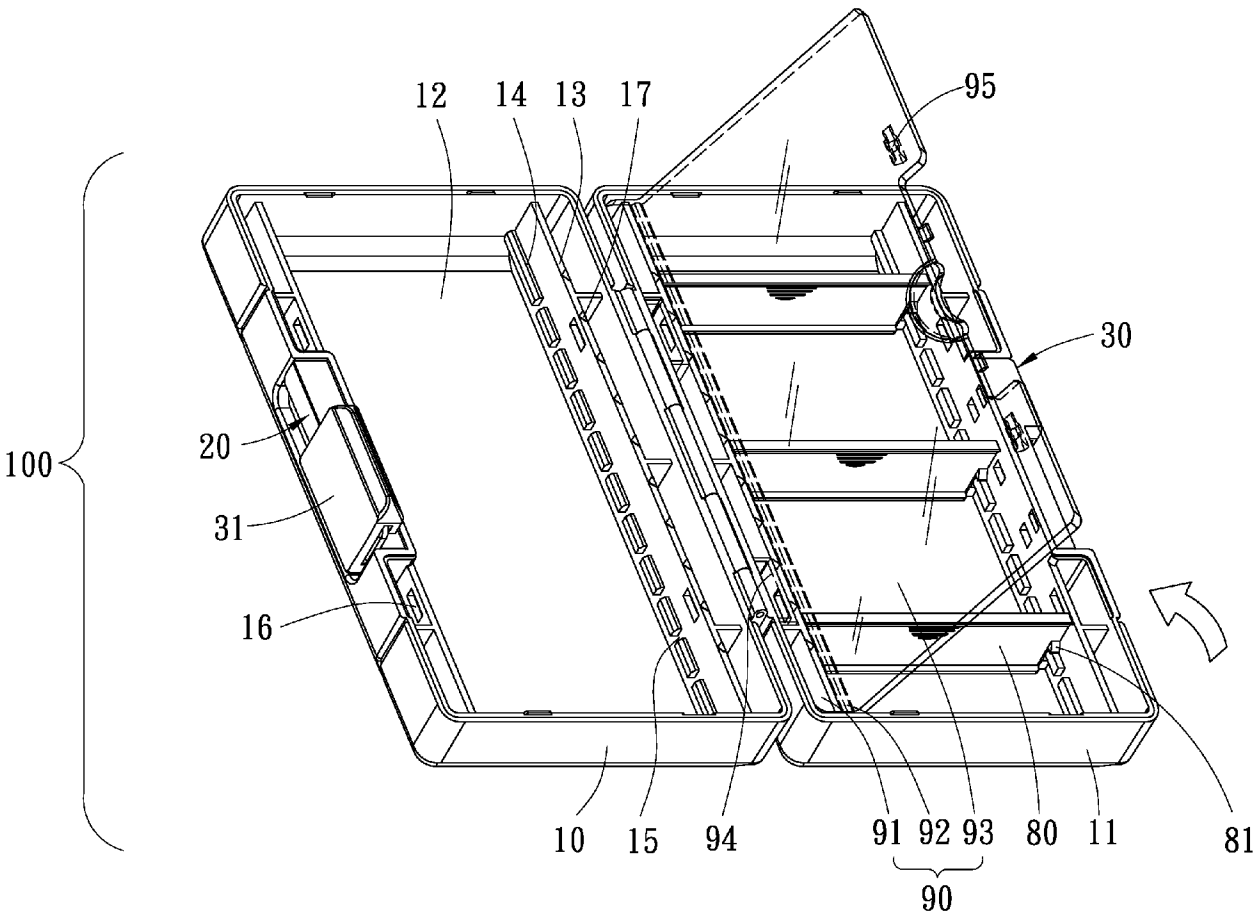
FIG. 17 is a perspective view of the toolbox in another position than shown in FIG. 16.

Referring to FIG. 17, the barbs of the elastic hooks 96 are removed from the related slots 16, and the elastic hooks 96 are removed from the related compartment 12. Thus, the pivotal portion 93 of the internal cover 90 is lifted from the second shell 11. Therefore, the compartments 12 of the second shell 11 are opened.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A toolbox comprising:

two pivotally connected shells each including at least two primary partitions formed on an internal side, a compartment defined between the primary partitions, a row of ribs formed on each of the primary partitions, and gaps each defined between two adjacent ones of the ribs;

a buckling unit for buckling the shells; and at least one tool-holding unit including:

a slide including two walls each including a wing movably supported on a related one of the rows of ribs, at least one block for abutment against a related one of the rows of ribs after it is inserted through a selected one of the gaps, and a channel defined therein;

a holder pivotally connected to the slide and formed with ribs each for contact with one of several faces of a tool; and two pins each inserted in a selected one of the gaps through a related one of the channel, thus positioning the slide on a related one of the shells.

2. A toolbox comprising:

two pivotally connected shells each including at least two primary partitions formed on an internal side, a compartment defined between the primary partitions, a row of ribs formed on each of the primary partitions, and gaps each defined between two adjacent ones of the ribs;

a buckling unit for buckling the shells; and at least one tool-holding unit including:

a slide including two walls each including a wing movably supported on a related one of the rows of ribs, at least one block for abutment against a related one of the rows of ribs after it is inserted through a selected one of the gaps, and a mark for alignment with any one of marks formed on a related one of the related shell to indicate that the block is moveable through a related one of the gaps; and a holder pivotally connected to the slide and formed with ribs each for contact with one of several faces of a tool.

3. A toolbox comprising:

two pivotally connected shells each including at least two primary partitions formed on an internal side, a compartment defined between the primary partitions, a row of ribs formed on each of the primary partitions, and gaps each defined between two adjacent ones of the ribs;

a buckling unit for buckling the shells; and at least one tool-holding unit including:

a slide including a floor including at least one aperture through which a fastener can be driven in a fixture so that the slide is attached to the fixture and two walls extending on the floor and each including a wing movably supported on a related one of the rows of ribs and at least one block for abutment against a related one of the rows of ribs after it is inserted through a selected one of the gaps; and a holder pivotally connected to the slide and formed with ribs each for contact with one of several faces of a tool.

4. A toolbox comprising:

two pivotally connected shells each including at least two primary partitions formed on an internal side, a compartment defined between the primary partitions, a row of ribs formed on each of the primary partitions, and gaps each defined between two adjacent ones of the ribs;

a buckling unit for buckling the shells; and at least one tool-holding unit including:

a slide including two walls each including a wing movably supported on a related one of the rows of ribs, at least one block for abutment against a related one of the rows of ribs after it is inserted through a selected one of the gaps, and at least one recess defined therein; and a holder pivotally connected to the slide and formed with ribs each for contact with one of several faces of a tool and two bosses for insertion in the recesses, thus positioning the holder on the slide.

5. A toolbox comprising:

two pivotally connected shells each including at least two primary partitions formed on an internal side, a compartment defined between the primary partitions, a row of ribs formed on each of the primary partitions, and gaps each defined between two adjacent ones of the ribs;

a buckling unit for buckling the shells; and at least one tool-holding unit including:

a slide including two walls each including a wing movably supported on a related one of the rows of ribs, at least one block for abutment against a related one of the rows of ribs after it is inserted through a selected one of the gaps, and an aperture defined therein;

a holder pivotally connected to the slide, wherein the holder includes ribs each for contact with one of several faces of a tool and two apertures defined therein; and two anchors each inserted into a related one of the apertures of the holder through a related one of the apertures of the slide, thus pivotally connecting the holder to the slide.

6. The toolbox according to claim 5, wherein the anchor includes a solid enlarged head abutted against the related wall of the slide, a slit enlarged head abutted against a portion of the holder, and a shaft inserted through the aperture of the holder and the aperture of the slide.

7. The toolbox according to claim 1, wherein the tool-holding unit includes:

a secondary partition with two opposite edges each inserted through a related one of the gaps of a related one of the primary partitions; and an internal cover pivotally connected to one of the shells.

8. The toolbox according to claim 7, wherein the secondary partition includes:

at least one barb for abutment against a face of a selected one of the ribs; and at least one boss for abutment against an opposite face of the selected rib.

9. The toolbox according to claim 7, wherein the internal cover includes:

a stationary portion attached to the related shell;

a pivotal portion for covering the compartment of the related shell; and a flexible portion for pivotally connecting the pivotal portion to the stationary portion.

10. The toolbox according to claim 1, wherein the buckling unit includes:

a first buckle-engaging element connected to one of the shells;

a second buckle-engaging element connected to the other shell; and a buckle movable between a releasing position and a locking position for locking the first and second buckle-engaging elements to each other.

11. The toolbox according to claim 10, wherein the first buckle-engaging element includes a flange, wherein the second buckle-engaging element includes a flange, wherein flanges are in a same plane and engaged with the buckle so that the first and second buckle-engaging elements are locked to each other by the buckle in the locking position.

12. The toolbox according to claim 11, wherein the buckle includes a dovetail groove for receiving the flanges.

* * * * *